US006691797B1

(12) United States Patent
Hart

(10) Patent No.: US 6,691,797 B1
(45) Date of Patent: Feb. 17, 2004

(54) DEVICE FOR DRIVING PILES

(76) Inventor: Duncan Hart, 4 Katrine Pl., Morrision Park, Cambusiano, Glasgow (GB), G72 7GX ( * ) Notice: Subject to any disclaimer, the term of this patent is extended or adjusted under 35 U.S.C. 154(b) by 86 days.

(21) Appl. No.: 10/018,444

(22) PCT Filed: Jun. 12, 2000

(86) PCT No.: PCT/GB00/02279

§ 371 (c)(1),
(2), (4) Date: Dec. 13, 2001

(87) PCT Pub. No.: WO00/77308

PCT Pub. Date: Dec. 21, 2000

(30) Foreign Application Priority Data

Jun. 14, 1999 (GB) ..... 9913785

(51) Int. Cl.[7] ..... E02D 11/00

(52) U.S. Cl. ..... 173/49; 173/128; 173/210; 405/232

(58) Field of Search ..... 173/49, 101, 128, 173/37, 33, 210, 211; 405/231, 232; 175/55

(56) References Cited

U.S. PATENT DOCUMENTS 4,143,719 A * 3/1979 Furukawa et al. ..... 173/49
5,257,667 A * 11/1993 Sano et al. ..... 173/128
5,263,544 A * 11/1993 White ..... 405/232
5,355,964 A * 10/1994 White ..... 173/49
5,568,997 A * 10/1996 Raunisto ..... 405/232
6,073,704 A * 6/2000 Yasuoka et al. ..... 173/37
6,386,295 B1 * 5/2002 Suver ..... 175/55

* cited by examiner

*Primary Examiner*—Scott A. Smith
(74) *Attorney, Agent, or Firm*—Camoriano and Associates; Theresa Fritz Camoriano; Guillermo E. Camoriano

(57) ABSTRACT

A device for use in combination with a pile driving apparatus for driving piles into the ground. The device (1) including a main body (13) which carries side grippers (18) and (19) each of which comprises a ram consisting of a piston and cylinder (20). A further gripper (23) is included, which extends downwardly of the main body (13) which grips the lower end of a pile, while grippers (18) and (19) are used to pick up and position a pile. A vibratory force generator (16) is operated to cause the main body (13) to vibrate thereby applying a downward vibrating force to the main body (13) and the pile held by the grippers (18, 19, 23), so driving the pile into the ground.

13 Claims, 2 Drawing Sheets

DEVICE FOR DRIVING PILES

CROSS-REFERENCE TO RELATED APPLICATIONS

This application claims priority from GB 9913785.3, filed June 14, 1999 and from PCTGB00/02279, filed Jun. 12, 2000.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISC

"Not Applicable"

BACKGROUND OF THE INVENTION

The present invention relates to a device for use in combination with pile driving apparatus for driving piles into and out of the ground, the device including a vibratory force generating means.

In order to drive piles into the ground, it is known to apply rapid hammer blows to the pile by means of a vibratory force generator. In such known systems, a steady force is applied to the pile by, typically, hydraulic means and the vibratory force generator is disposed between the point of application of the steady force and the pile. It is also known from, for example EP 648297, to apply the vibratory force through apparatus which grips the pile. For driving long piles and in situations where it is not possible to obtain free access above the pile, it is known to grip the pile intermediate its length by sideways extending gripper arms and to transmit the vibratory force through the gripper arms. As shown in EP 648297 it is also known for the gripper arms to be pivotable between the horizontal position for gripping a pile intermediate its length and a vertical position for gripping the end of a pile for the completion, or start, of pile driving or removal.

The known systems have the disadvantage that the vibratory forces are transmitted through pivot pins, by which the gripper arms are pivoted between their various positions, and piston rods of the gripper means. Because of their nature, these points constitute weak areas in the passage of the driving force which limits the amount of driving force which can be applied to the pile and also results in a short life for the components.

It is also known from JP58117129 to provide a device for driving piles which is suitable for connection to a force generating machine. An oil-pressure vibro device transmits a vibratory force directly to a vertical chuck or a horizontal chuck. However, the range of movement of the gripping means is very limited. It is not possible to manipulate the gripping means to pick up a pile from the ground and place the pile in a upright position for driving.

BRIEF SUMMARY OF THE INVENTION

The present invention seeks to provide improved means for transmitting the driving forces to the pile.

According to the present invention there is provided a device for use in combination with a force generating apparatus for driving piles into and out of the ground, the device including a main body having a vibratory force generator and first gripping means which, when the main body is in the operative orientation to enable vertical pile driving to take place, extends horizontally from the main body for gripping a vertically disposed pile intermediate its length, and second gripping means extending from the main body generally perpendicularly downwardly relative to the first gripping means for gripping the end of a vertically disposed pile, characterized in that resilient means are interposed between the main body and coupling means through which coupling means the device is adapted to be connected to the force generating apparatus, the coupling means being drivably pivotable in more than one plane.

In an alternative aspect of the present invention there is provided a device for use in combination with a force generating apparatus for driving piles into and out of the ground, the device including a main body, resilient means interposed between the main body and coupling means through which coupling means the device is adapted to be connected to the force generating apparatus, the main body having a vibratory force generator and first gripping means which, when the main body is in the operative orientation to enable vertical pile driving to take place, extends generally horizontally from the main body for gripping a vertically disposed pile intermediate its length, the gripping means comprising at least one pair of horizontally opposed gripping members at least one of which is a fluid operable ram having a piston fixedly secured relative to the main body and a cylinder movable towards and away from the opposed gripping member.

When constructed according to this aspect of the invention, the device may also incorporated a said second gripping means. The second gripping means may comprise at least one pair of opposed fluid operably rams, having a piston fixedly secured to the main body and a cylinder movable by said fluid towards and away from the opposed ram.

In an alternative embodiment, the or each gripping means may comprise a fixed reaction point and a ram movable towards and away from the fixed reaction point.

In an alternative embodiment, where the gripping means comprises a pair of opposed rams, one of the rams is movable to a fixed predetermined gripping location, before the second ram completes its movement to grip a pile between the two rams.

Preferably, the or each cylinder is slidable in an associated bore in said main body.

A preferred embodiment of the invention will now be described by way of example with reference to the accompanying drawings in which:

DETAILED DESCRIPTION OF A PREFERRED EMBODIMENT OF THE INVENTION

Figure 1:
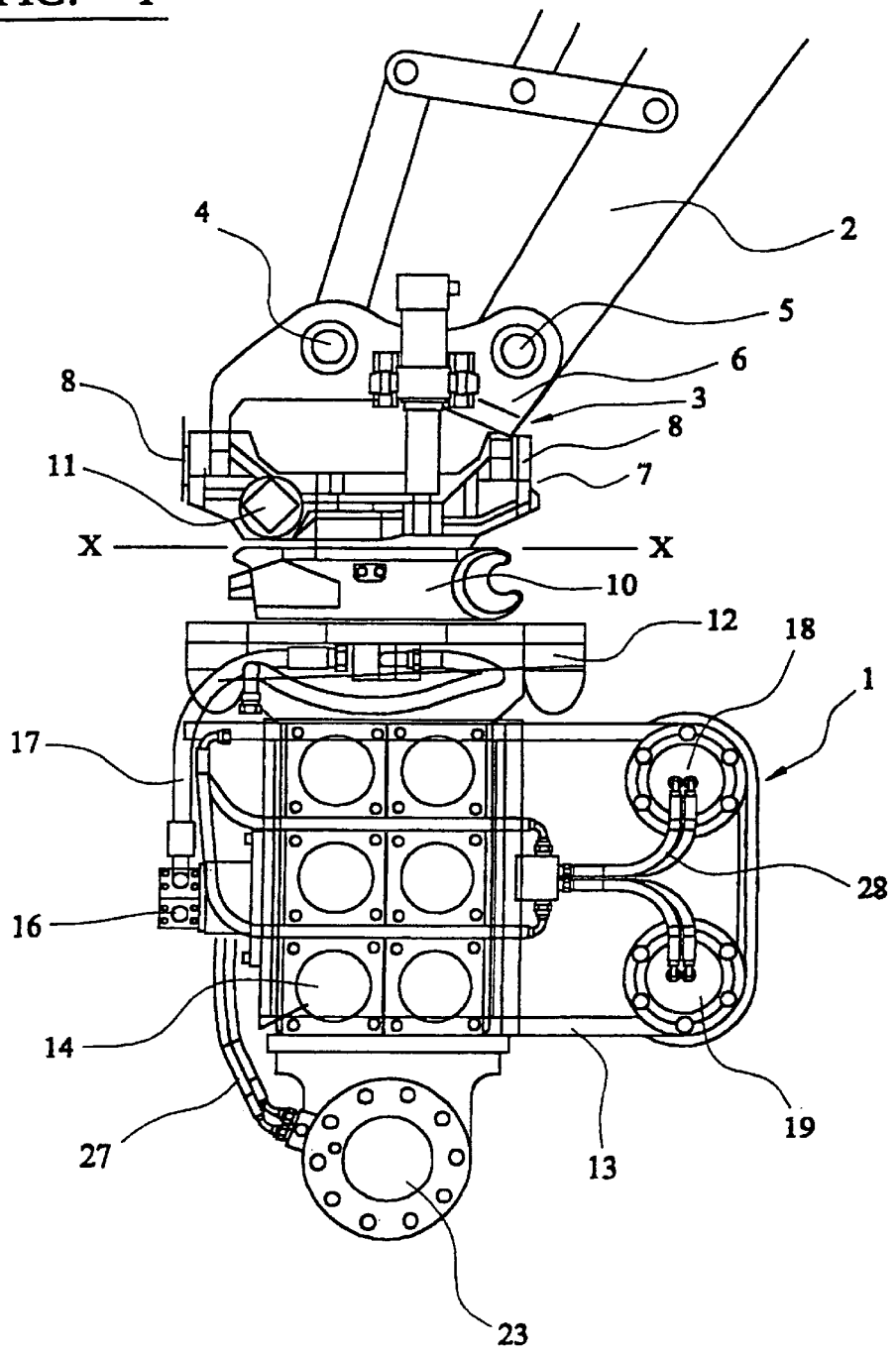
FIG. 1 shows a side view of the device and a coupling means.
Figure 2:
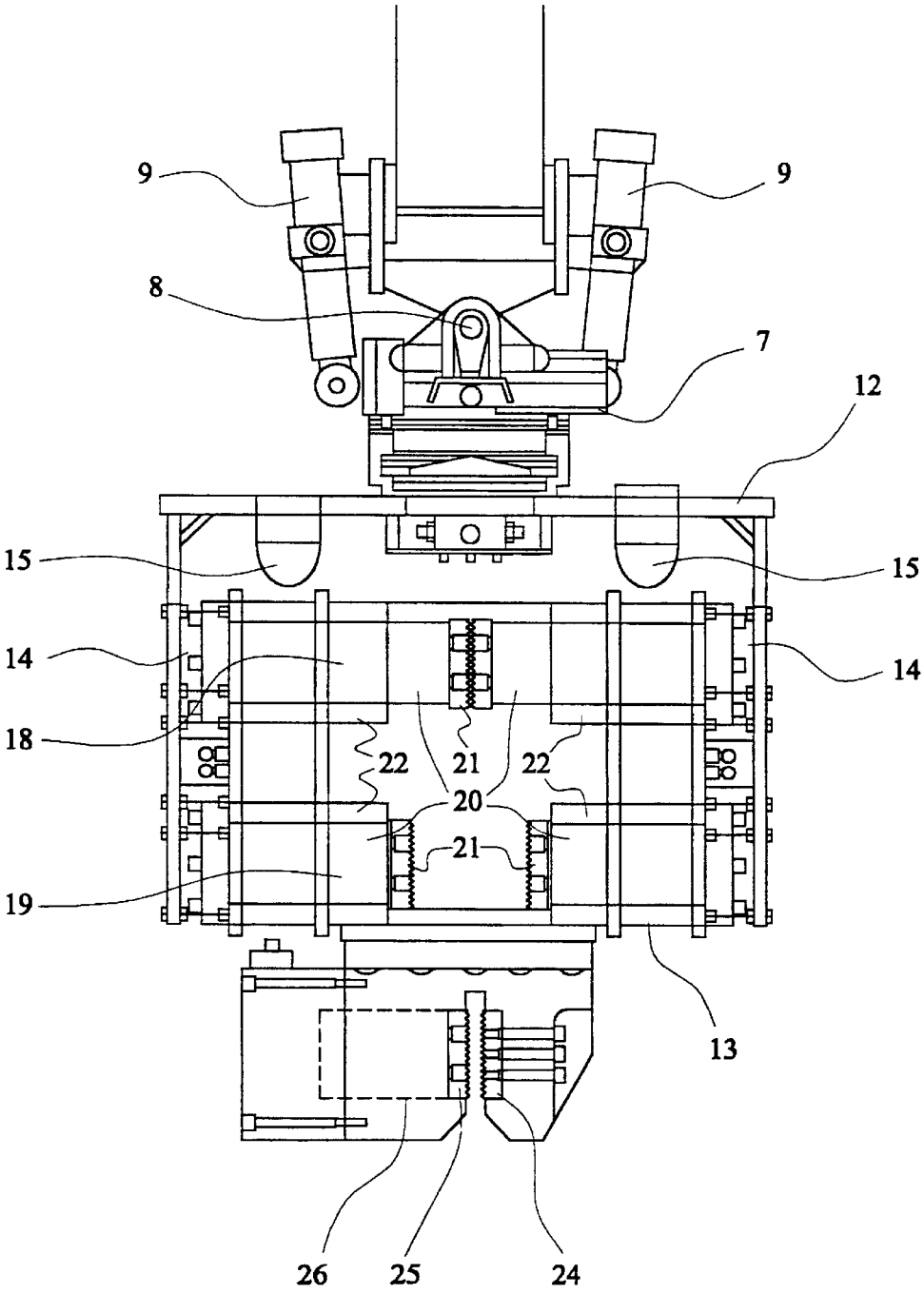
FIG. 2 shows an end view of the device.

Referring now to FIG. 1 of the drawings there is shown a device 1 adapted to be connected to a hydraulically operable boom 2 of an excavator or similar machine by means of a coupling device 3. The coupling device is mounted on the boom 2 through pivot connections 4 and 5 on an upper framework member 6 of the coupling means. The member 6 has a body 7 pivotally mounted thereon on pins 8. Pivotal movement of the body 7 is controlled by two hydraulically operable ram and cylinder devices 9 which are each pivotally mounted on opposed sides of the upper frames 6 as shown in FIG. 2 and pivotally connected to opposite sides of the body 7.

The coupling means 3 has a lower coupling element 10 which is rotatable relative to the main body 7 through 360° about a vertical pivot axis by means of a hydraulic motor 11. The gripping device 1 is adapted to be connected to the lower coupling element 10 by quick release fastening. The gripping device 1 has a main connecting member 12 secured to the coupling element 10 rigidly, and a main gripper body 13 which is connected to the connecting member 12 through twelve resilient elements 14, six of which are located on each side of the connecting member 12. The resilient elements 14 are substantially more flexible than the elements 10, 12 and more flexible than the rigid main gripper body 13, thereby providing a flexible connection between the main gripper body 13 and the coupler 3, which isolates the coupler 3 from the vibrations in the main gripper body 13. This protects the weak, movable elements of the coupling means 3, such as pivot pins and piston rods, from excessive wear that would otherwise be caused if the coupler 3 and main gripper body 13 were connected together rigidly or through a pivot connection. The connecting member 12 has four depending rubber buffers 15 to limit the movement of the main body 13 towards the connecting member 12.

The main body 13 comprises a substantially rigid box-like construction open at one side and supports a vibratory force generator 16 which consists of a hydraulic motor powered through pipes 17 from the main hydraulic power source on the excavator. The hydraulic motor rotates a shaft through a gearing system (not shown) which carries an eccentric mass offset from its axis of rotation. The shaft is mounted in two bearings, each consisting of a lower half bearing located in a rigid cradle rigidly secured to the main body 13, the bearings being completed with bearing cups which form the upper halves of the bearings and are secured by bolts to the cradle. The main body carries two pairs of side grippers 18 and 19, each of which comprises a ram consisting of a piston (not shown) rigidly secured to the main body 13 and a cylinder 20 movable towards and away from the opposed cylinder 20 by the application thereto or removable therefrom of hydraulic fluid. Each cylinder carries on its outer end a gripper member 21 having a serrated face. Each cylinder 20 is slidable in an associated bore 22 in the main body and has a chrome finish to reduce friction between the bore 22 and the cylinder 20. Hydraulic fluid to and from the cylinders is supplied through pipes 28 from the hydraulic power source on the excavator.

As can be seen from FIG. 1, the grippers 18 and 19 are mounted in the main body so as to be laterally offset from the axis about which the main body pivots relative to the coupling means. The device also includes a further or lower gripper means 23 extending downwardly of the main body 13 and having gripping surfaces aligned substantially with the axis of rotation of the main body about the coupling means. The gripper means 23 comprises a gripping face or abutment 24 fixed in relation to the main body 13 and a cylinder 25 slidable in a bore 26 in a downward extension of the main body. Hydraulic fluid to and from the cylinder is supplied through pipes 27 connected to the hydraulic power source of the excavator.

In operation, when the device 1 is attached to the boom 2 of the excavator by the coupling means 3, the excavator driver is then able to pivot the gripper device through 360° about a vertical axis with his boom 2 stationary, and is also able to pivot the gripping means relative to the boom by operation of the boom hydraulics to pivot the device about the pivot axes of pivot connections 4 and 5. Fine alignment of the device can be achieved by pivoting the coupling means bout the pivot axis of pins 8 by selective operation of the hydraulic cylinders 9.

In this way, the operator can pick up a pile lying horizontally on the ground by holding it intermediate its length and he can then position it for vertical pile driving. In operation, one of the cylinders 20 of each pair of side grippers 18 and 19, is moved to a predetermined location slightly ahead of movement of the opposed cylinder 20. In this way, the position of the pile is accurately located relative to the central axis of the coupling means and device thus reducing stresses which would be generated if the pile, when being driven, were offset. A downward load is applied to the pile by operation of the boom, this force being transmitted through the gripper device 1. The vibratory force generator 16 is then operated and the vibratory force generated by the eccentric weight causes the main body 13 to vibrate and apply a downward vibratory force to the main body and hence to the pile held by the grippers.

As the pile is driven into the ground, the gripper device is repositioned up the pile at predetermined intervals. Once the top end of the pile comes within reach of the boom and the gripper device, the end of the pile is gripped in the lower gripper means 23 and pile driving is continued until the pile is driven to the desired position. To remove a pile, the forces applied are reversed by lifting the boom 2 to apply a lifting force to the device 1. The vibratory force generator thereby reverses its effect and assists in the withdrawal of the pile from the ground.

It will be appreciated that variations may be made in the apparatus. For example, although the side gripping members are shown as having two pairs of opposed grippers it is envisaged that only one pair of opposed grippers may be provided, whilst for more heavy duty applications, three or even more pairs could be provided. Equally, in another embodiment, each gripper may have only one movable cylinder which is movable towards and away from a fixed abutment located so as to ensure that a pile gripped therebetween is held in the correct position. Similarly, although the lower gripper 23 is described as having one cylinder only cooperating with the fixed abutment, it will be appreciated that two opposed cylinders may be provided for this location.

What is claimed is:

1. A pile driver for attachment to a boom, comprising:

a rigid main gripper body;

a vibratory force generator mounted on said main gripper body;

a first gripper mounted on said main gripper body, said first gripper extending in a first direction from the main gripper body for gripping a vertically disposed pile intermediate its length;

a second gripper mounted on said main gripper body and extending perpendicularly to said first gripper for gripping the end of a vertically disposed pile;

a coupler, including a rigid lower coupling element for mounting to the rigid main gripper body, and an upper framework member for mounting to the boom; said coupler defining at least two pivot axes lying in two different planes which permit relative movement between said upper framework member and said lower coupling element, and including drivers which drive said coupler about its two pivot axes so as to control the relative positions of said upper framework member and said rigid lower coupling element; and at least one resilient element, wherein said rigid lower coupling element of said coupler is connected to said rigid main gripper body through said resilient element in order to help isolate said coupler from the effects of said vibratory force generator.

2. A pile driver for attachment to a boom as recited in claim 1, wherein said first gripper includes at least one pair of opposed gripping members, at least one of which is a fluid operable ram having a piston fixedly secured relative to the main gripper body and a cylinder movable towards and away from the opposed gripping member.

3. A pile driver for attachment to a boom as recited in claim 2, wherein said first gripper includes two pairs of opposed gripping members, each including a pair of opposed rams, and said second gripper includes at least one pair of opposed rams.

4. A pile driver for attachment to a boom as recited in claim 3, where one of the rams of the second gripper is movable to a fixed predetermined gripping location before its opposed ram completes its movement to grip a pile between said pair of opposed rams.

5. A pile driver for attachment to a boom as recited in claim 3, wherein at least one of the first and second grippers includes a fixed reaction point and a ram movable towards and away from the fixed reaction point.

6. A pile driver for attachment to a boom as recited in claim 3, wherein said main gripper body defines a plurality of opposed bores, and each of said rams includes a cylinder slidable in its respective bore in said main gripper body.

7. A pile driver for attachment to a boom as recited in claim 6, and further comprising a resilient bumper which limits the relative movement between said coupler and said rigid main gripper body.

8. A pile driver for attachment to a boom as recited in claim 1, wherein said second gripper includes at least one pair of opposed rams.

9. A pile driver for attachment to a boom as recited in claim 8, where one of the rams of the second gripper is movable to a fixed predetermined gripping location before its opposed ram completes its movement to grip a pile between said pair of opposed rams.

10. A pile driver for attachment to a boom as recited in claim 8, wherein at least one of the first and second grippers includes a fixed reaction point and a ram movable towards and away from the fixed reaction point.

11. A pile driver for attachment to a boom, comprising:

a rigid main gripper body;

a vibratory force generator mounted on said main gripper body;

a first gripper mounted on said main gripper body, said first gripper extending in a first direction from the main gripper body for gripping a vertically disposed pile intermediate its length;

a second gripper mounted on said main gripper body and extending perpendicularly to said first gripper for gripping the end of a vertically disposed pile;

a coupler, including an upper framework member and a lower coupling element, said coupler defining two parallel, non-coaxial pivot connections in its upper framework member for mounting the upper framework member to a boom, and further comprising at least one pivot axis and a driver for controlling a relative motion between said upper framework member and said lower coupling element about said one pivot axis; and at least one resilient element, wherein said lower coupling element of said coupler is connected to said rigid main gripper body through said resilient element in order to help isolate said coupler from the effects of said vibratory force generator.

12. A pile driver for attachment to a boom as recited in claim 11, wherein said coupler includes a vertical pivot axis and a horizontal pivot axis.

13. A pile driver for attachment to a boom as recited in claim 12, and further comprising a fluid-operated motor which drives the coupler about said vertical pivot axis and a fluid-operated cylinder which drives the coupler about said horizontal pivot axis.

* * * * *